United States Patent [19]

Bouchard et al.

[11] Patent Number: 5,059,864

[45] Date of Patent: Oct. 22, 1991

[54] NEGATIVE GLOW LAMP

[75] Inventors: Andre C. Bouchard, Peabody; Paul Thibault, Danvers; Tom Haraden, Ipswich, all of Mass.

[73] Assignee: GTE Products Corporation, Danvers, Mass.

[21] Appl. No.: 455,527

[22] Filed: Dec. 22, 1989

[51] Int. Cl.[5] ..... H05B 41/14; H01J 17/34

[52] U.S. Cl. ..... 315/56; 315/58; 315/235; 315/260

[58] Field of Search ..... 315/56, 58, 235, 260, 315/239, 241 R, 247, 248, 227 R; 313/310

[56] References Cited

U.S. PATENT DOCUMENTS

| | | | |
|---|---|---|---|
| 2,067,129 | 1/1937 | Marden | 250/27.5 |
| 3,814,971 | 6/1974 | Bhattacharya | 313/226 |
| 4,408,141 | 10/1983 | Byszewski | 315/56 |
| 4,611,148 | 9/1986 | Kato et al. | 313/595 |
| 4,644,224 | 2/1987 | Saita et al. | 313/634 |
| 4,688,874 | 8/1987 | Bjorkman | 439/56 |
| 4,751,435 | 6/1988 | Roche et al. | 315/235 |
| 4,871,944 | 10/1989 | Skwirut et al. | 315/56 |
| 4,904,900 | 2/1990 | Bouchard et al. | 313/491 |

*Primary Examiner*—Eugene R. LaRoche
*Assistant Examiner*—Ali Neyzari
*Attorney, Agent, or Firm*—Wolf, Greenfield & Sacks

[57] ABSTRACT

A negative glow discharge lamp, which includes a light transmitting envelope containing a noble gas film material and a pair of electrodes disposed in the envelope. Ballast capacitors are placed within the base of the lamp and preferably within a cavity formed within the wall of the base surrounding a necked-down portion of the envelope.

5 Claims, 2 Drawing Sheets

NEGATIVE GLOW LAMP

TECHNICAL FIELD

The present invention relates in general to a compact fluorescent lamp containing a pair of electrodes in a phosphor coated envelope, and more particularly to a negative glow discharge lamp.

BACKGROUND OF INVENTION

A negative glow discharge lamp typically comprises a light-transmitting envelope, which contains a noble gas and mercury (Hg) with a phosphor coating on the inner surface of the envelope. This coating enables the emission of visible light upon absorption of ultraviolet radiation that occurs when the electrical circuit is activated and ultraviolet radiation is emitted. The phosphor coating absorbs the emitted ultraviolet radiation. Examples of typical glow discharge lamps are found in U.S. Pat. No. 2,067,129 to Marden; U.S. Pat. No. 3,814,971 to Bhattacharya; U.S. Pat. No. 4,408,141 to Byszewski, et.al., and U.S. Pat. No. 4,751,435 to Roche, et.al. Such lamps can be operated from either an AC or DC power source.

Various attempts have been made to produce fluorescent lamps with bulb bases whereby the lamps may be mounted into standard screw-type sockets. In such arrangements the starting circuit for such lamps must be located some place in the lamp. In U.S. Pat. No. 4,688,874 to Bjorkman it has been suggested to provide an adapter which has a screw base and a holder to receive the fluorescent lamp. The adapter carries such ignition and drive circuitry.

In U.S. Pat. No. 4,871,944 to Skwirut et.al., a screw-in type base fluorescent lamp is shown which contains a tridimensional convoluted tubular envelop and circuit elements within the lamp unit.

In U.S. Pat. No. 4,644,224 to Saita et.al., there is disclosed a low pressure mercury vapor discharge lamp in which a starting circuit is enclosed in a separate case mounted above a screw-in bulb case and to which in turn a glass lamp envelope is mounted.

In all such devices, the resultant lamp is unacceptably lengthened or the structure employed makes the lamp unit impractical from a commercial standpoint.

SUMMARY OF THE INVENTION

It is one object of the invention to provide a negative glow discharge lamp in which the overall length thereof is shortened.

It is a further object of the invention to provide for the placement of a capacitor or capacitors used in the electrical circuit within the base of a lamp in an improved manner.

A further object of the present invention is to provide an improved negative glow discharge lamp comprising an envelope having an exhaust tubulation which is not subject to breakage during lamp-ballast assembly.

A still further object of the invention is to provide an improved negative glow discharge lamp having an envelope with exhaust tubulation substantially lengthened, which is characterized by a reduction in the mercury cold spot temperature.

These and further objects of the invention will become more readily apparent from a reading of the description following hereafter.

DETAILED DESCRIPTION OF THE INVENTION

Figure 1:
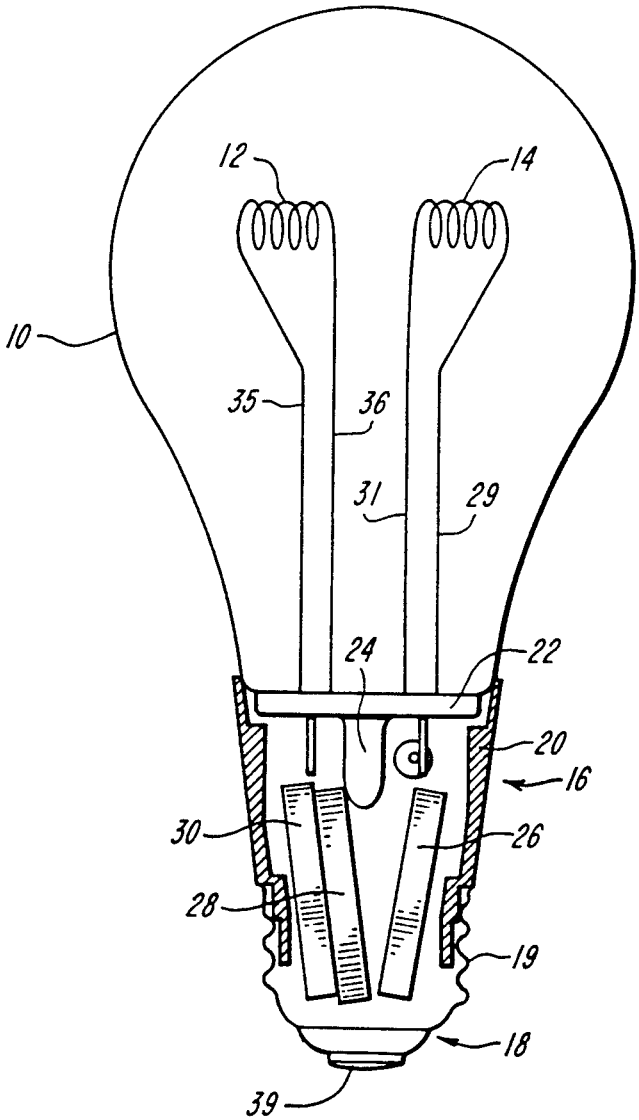
FIG. 1 is an elevational cross sectional view of a negative glow discharge lamp according to the invention indicating the location of the capacitors within the base portion of the lamp.

The above and further objects of the invention are better understood as well as further advantages and capabilities thereof with reference to the following discussion of the above described drawings and a reading of the appended claims. As seen in FIG. 1, a negative glow discharge lamp is shown which comprises an envelope 10 which contains a noble gas or mixtures of noble gas, e.i., neon, with mercury. The envelope 10 normally has a phosphor coating on its inner surface. The lamp contains one or more electron emitting electrodes such as the cathode 12 and one or more electron collecting electrodes such as the anode 14. The cathode emits electrons that are accelerated such that the mercury vapor can be excited in the extended region of the low pressure gas. Such a device can be operated from an AC or DC power source. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation.

Figure 3:
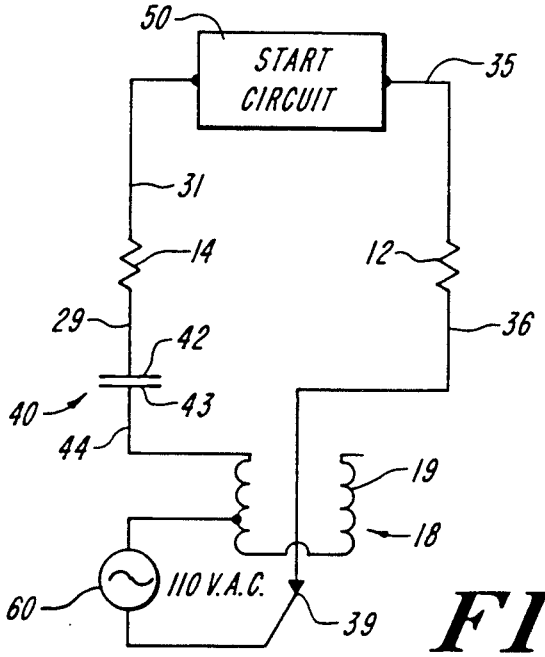
FIG. 3 is a schematic diagram of the negative glow discharge lamp of FIG. 1, showing the ballast capacitor connections.

When operated at standard line voltages of 110V AC, the line voltage is usually reduced by inserting a capacitive ballast in the electrical circuit. A typical circuit of this type is shown in FIG. 3 wherein electrodes 12 and 14 function alternately as an accelerating electrode and cathode, depending on the instantaneous polarity of the AC voltage. At any given time, one electrode is an accelerating electrode and the other is a cathode. Electrode 12 is connected between conductors 35 and 36, and electrode 14 is connected between conductors 31 and 29. Conductor 29 connects to one side 42 of a ballast capacitor 40, which may be a single capacitor but normally is a series of capacitors, and the other side of electrode 14 is coupled to a start circuit 50 via a lead 31. Electrode 12 is connected on one side, via conductor 35 to the start circuit 50, and on the remaining side 36 to a center contact 39 of base 18 via conductor 36. Lastly, conductor 44 connects the remaining side 43 of the capacitor ballast 40 to the threaded contact portion 19 of lamp base 18.

In operation, the circuit is activated by switching the lamp on whereby an AC voltage from a source 60 is applied across the center base contact 39 and the screw-in outer contact 19 of base 18. Capacitor 40 acts as a voltage reducer and generates a voltage proportional to the quantity of charge stored in it. On the positive first-half cycle of the AC voltage, electrode 12 will be at a positive polarity with respect to electrode 14. As a result, electrode 14 will function as a thermionic cathode emitting electrons that are accelerated through the cathode fall. The next alternate half cycle of the AC voltage, electrode 14 will be positive with respect to electrode 12. Then electrode 12 will function as a thermionic cathode emitting electrons that are accelerated through the cathode fall. As is well known, some of these accelerated electrons collide with mercury in the negative glow region causing excitation of the atoms and emission of ultraviolet radiation.

Although not shown, the lamp may be operated in a DC mode of operation rather than an AC mode of operation.

As shown in FIG. 1, the ballast 40 may consist of a series of three discrete ceramic capacitors 26, 28 and 30. Typically, these may be one inch long by one-half inch wide by one-eighth inch thick. These capacitors may be placed within the base 16 under the lamp proper and nestled about the lamp exhaust tubulation 24. It is important to insure that the capacitors are placed at the furthest distance from the tubulation because during positioning and assembly, it is possible that breakage of the tubulation may occur. Additionally, in the embodiment of FIG. 1, the tubulation 24 should be kept as short as possible so as not to interfere with the placement of the capacitors.

Although capable of functioning in a satisfactory manner, the construction shown in FIG. 1 may experience the operational circumstance that heat generated by the capacitors 26, 28 and 30 during lamp operation may be conducted to the exhaust tubulation causing an elevation of the temperature of the mercury condensed in the tubulation. This will cause an elevated Hg pressure and reduce the efficiency of the lamp.

Figure 2:
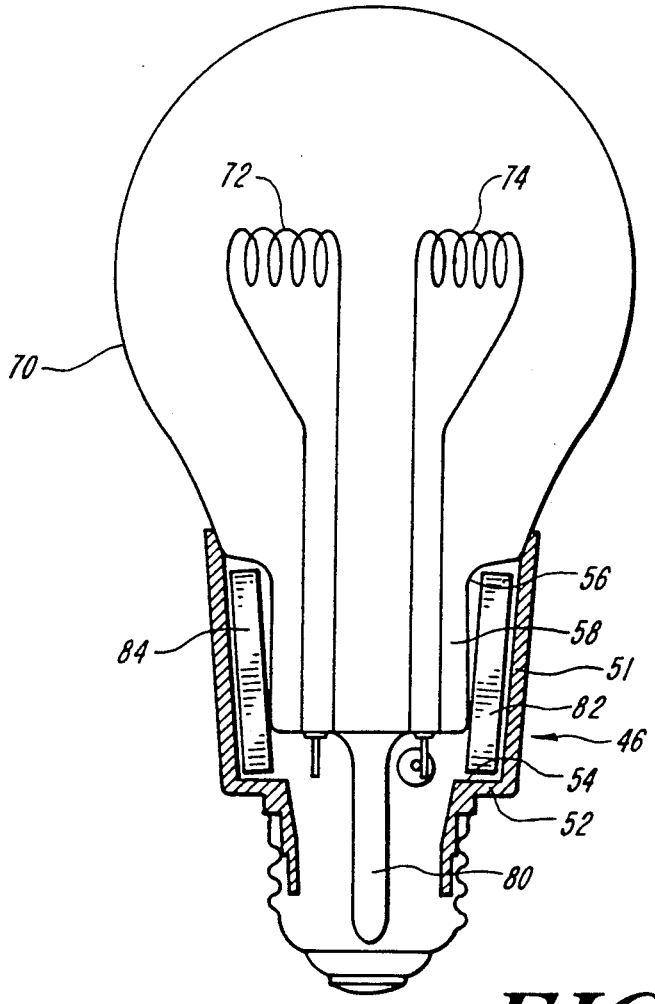
FIG. 2 is an elevational cross-sectional view of a preferred form of negative glow discharge lamp providing for the location of the capacitors within the lamp base.

A preferred embodiment is shown in FIG. 2, wherein the aforementioned shortcoming can be circumvented if the lower region of the base 46 of the lamp is formed in the manner shown. In FIG. 2, the envelope 70 contains the electrodes 72 and 74 in a circuit similar to that illustrated in FIG. 3. However, in this construction the envelope 70 is necked down in the area 56 of the neck 58 of the envelope so as to form a cavity between the neck 58 and the wall 51 of base 46. The base 46 has the wall 51 formed with a stepped portion 52 so as to provide a shelf 54 for the nesting of the capacitors such as 82, 84. The capacitors 82 and 84 are placed within the cavity so that they are mechanically restrained from any possible interference with the exhaust tubulation 80. Thereby any possibility of breakage of the tubulation during lamp and ballast assembly is eliminated. Additionally, the tubulation 80 may be made longer as shown in FIG. 3 in order to reduce any mercury cold spot temperature.

While there has been shown and described what at present are considered to be the preferred embodiments of the invention, it will be obvious to those skilled in the art that various changes and modifications may be made therein without departing from the spirit and scope of the invention as defined by the appended claims. For example, the capacitor 40 may be a single capacitor in the form of a toroid nested on the shelf 54.

What we claim is:

1. A negative glow discharge lamp comprising:

a light transmitting envelope containing a gas fill material and having a neck portion terminating in an exhaust tubulation, at least a pair of electrodes disposed in said envelope, an activating electrical circuit for said electrodes, including one or more capacitors, a lamp base having a socket portion provided with an outer wall, said base further includes a shelf portion, said envelope being assembled to said base with its neck portion enclosed within the socket portion, said neck portion being spaced from the outer wall of said socket portion of the base to create a cavity therebetween, and said one or more capacitors being located on the shelf portion within said base in the cavity between said neck portion and said outer wall.

2. The glow discharge lamp of claim 1 wherein said one or more capacitors comprises a plurality of ceramic capacitors located within the said cavity on the shelf portion.

3. The glow discharge lamp of claim 1 wherein said exhaust tubulation is relatively long as related to the length of said one or more capacitors and said tubulation extends below and away from said one or more capacitors.

4. A glow discharge lamp as defined in claim 1 wherein said one or more capacitors is spaced from the exhaust tubulation and is located in the cavity so as to be mechanically restrained from interference with the exhaust tubulation.

5. A glow discharge lamp as defined in claim 1 wherein said neck portion has a smaller dimension than the remainder of said envelope so as to define said cavity.

* * * * *